United States Patent [19]

Epstein

[11] 4,111,014

[45] Sep. 5, 1978

[54] COMBINATION LOCK

[76] Inventor: Norman Epstein, Rte. 301, Carmel, N.Y. 10512

[21] Appl. No.: 759,454

[22] Filed: Jan. 14, 1977

[51] Int. Cl.[2] ..... E05B 37/06

[52] U.S. Cl. ..... 70/25; 70/312

[58] Field of Search ..... 70/25, 26, 312, 323

[56] References Cited

U.S. PATENT DOCUMENTS

| | | | |
|---|---|---|---|
| 1,773,204 | 8/1930 | Scheibner | 70/26 |
| 3,633,393 | 1/1972 | Hisatsune | 70/276 |

*Primary Examiner*—Robert L. Wolfe

*Attorney, Agent, or Firm*—Edward F. Levy

[57] ABSTRACT

A combination lock includes a plurality of setting wheels each having a sliding pin and each having a plurality of numerals marked on a peripheral surface. When the setting wheels are rotated to a predetermined combination of numerals, the sliding pins form a linear array. A manually operated plunger urges a cam surface against a first end of the linear array of sliding pins and transmits a force through the sliding pins causing a second end of the linear array to bear against a latch bar thus opening the combination lock.

10 Claims, 6 Drawing Figures

FIG. 1
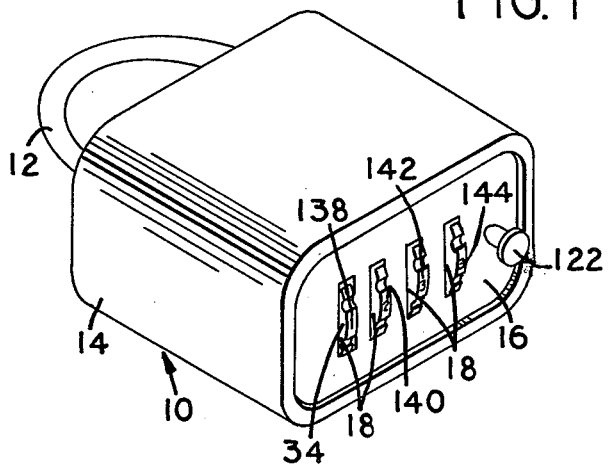
FIG. 2
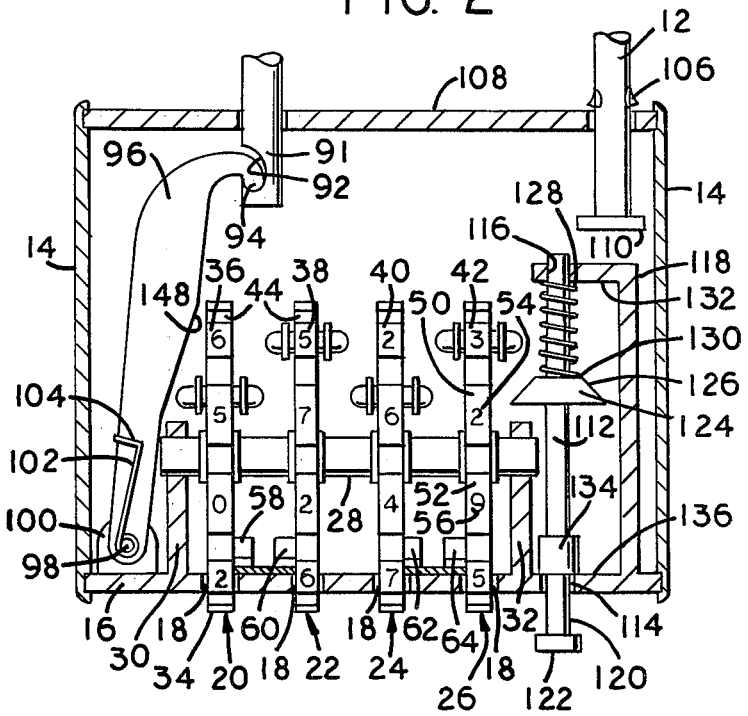
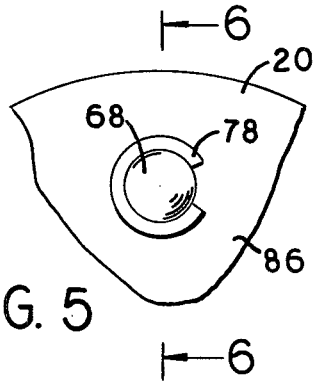
FIG. 5

FIG. 3
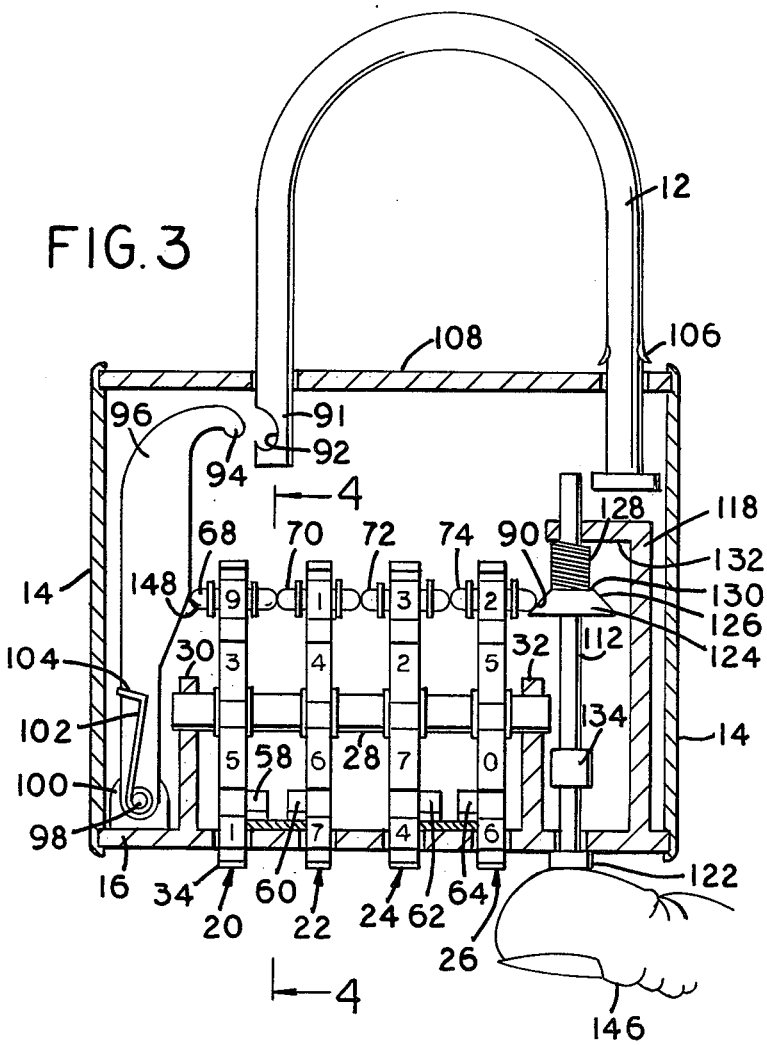
FIG. 4
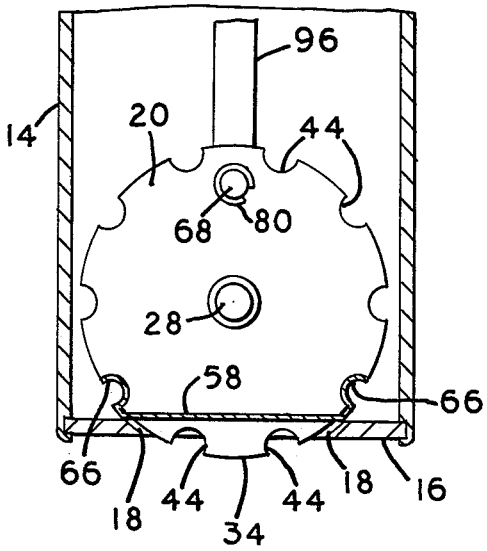
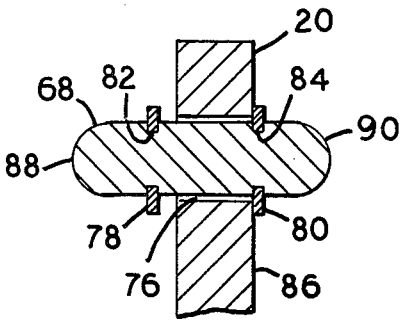
FIG. 6

COMBINATION LOCK

The present invention relates generally to locks and more particularly to a novel combination lock.

Conventional combination locks employ a plurality of disc-like tumblers each having a radial slot in one particular position. To open a conventional combination lock, the tumblers are rotated by a dial, in a prescribed manner, so that all of the slots are in alignment, at which time a fence, which normally rests on the edge of the tumblers, drops into the slots and causes a bolt to be drawn. In the past, unauthorized opening of such locks has been performed by skilled persons who sense the relative positions of the slots and the fence by a combination of the sound and friction produced when the dial is rotated. Various attempts have been made to prevent unauthorized opening of such locks by incorporation of noise mufflers, lubricating means, tumblers made of selected low friction materials and other modifications designed to prevent the sensing of the position of the slots relative to the fence. These modifications increase the security of conventional combination locks; however they also increase their manufacturing costs and their complexity.

It is an object of the present invention to overcome the disadvantages of the prior art by providing a combination lock employing a novel principle of operation which eliminates the need for slotted tumblers.

Another object of the present invention is to provide a combination lock which utilizes a linear array of sliding pins to activate the lock.

Another object of the present invention is to provide a combination lock which produces no noise or friction when the tumblers are set to the proper combination.

Still another object of the present invention is to provide a low cost combination lock which provides a high degree of security and is virtually pick-proof.

In accordance with the invention, there is provided a combination lock having a plurality of disc-shaped wheels which are free to rotate independently of each other on a common axle. A pin is slideably mounted on each wheel at a selected location and is free to slide a limited distance in a direction perpendicular to the wheel. When all of the wheels are rotated into a predetermined relationship, in accordance with the combination, the pins form a linear array. A cam surface is provided which is activated from outside the lock and which presses against one end of the linear array of pins and pushes the pins together and against a shackle bar thus opening the lock. The combined length of the pins is such that it is just short of being sufficient to activate the shackle bar without the action of the cam surface. If any one of the pins is not in proper alignment, the combined length of the remaining pins is not sufficient to permit the opening of the lock.

Additional objects and advantages of the invention will become apparent during the course of the following specification, when taken in connection with the accompanying drawings in which:

FIG. 1 is an overall perspective view of a combination lock made in accordance with the present invention;

FIG. 2 is a longitudinal sectional view of the combination lock of FIG. 1, shown in the locked position with portions of the shackle broken away;

FIG. 3 is a longitudinal sectional view of the combination lock similar to FIG. 2 but showing the combination lock in the process of being opened;

FIG. 4 is a fragmentary sectional view taken along the line 4—4 of FIG. 3;

FIG. 5 is an enlarged fragmentary view of a portion of FIG. 4 showing an end view of one of the sliding pins; and FIG. 6 is a fragmentary sectional view taken along the line 6—6 of FIG. 5.

Referring in detail to the drawings, there is shown in FIG. 1 a preferred embodiment of a combination lock 10 made in accordance with the present invention. The combination lock 10 comprises a shackle 12 mounted on a case 14 having a bottom wall 16 provided with a plurality of spaced slots 18. A plurality of setting wheels 20, 22, 24 and 26 are rotatably mounted within case 14 on a shaft 28 which is supported by supports 30 and 32 which project from the bottom wall 16. A portion 34 of each of the plurality of setting wheels 20, 22, 24 and 26 projects through an adjacent slot 18 for the purpose of facilitating mannual rotation of the setting wheels 20, 22, 24 and 26 by an operator during the process of opening the combination lock 10. The peripheral surfaces 36, 38, 40 an 42 of each of the setting wheels 20 22, 24 and 26 are each divided by a plurality of equally spaced semi-circular notches 44. Portions of the peripheral surface 42, between the notches 44, are each marked with indicia such as a numeral. For example the indicia 54 shown in FIG. 2 on portion 50 is the numeral "2", while the indicia 56 on portion 52 is the numeral "9".

Adjacent to each of the setting wheels 20, 22, 24 and 26 there is mounted on the bottom wall 16 a respective spring detent member 58, 60, 62 and 64. Each spring detent member is formed with a pair of semi-circular portions 66 (FIG. 4) each of which extend into a semi-circular notch 44 of the adjacent wheel. The spring detent members 56, 60, 62 and 64 are biased in a direction to engage the notches 44 sequentially as the respective wheels are turned, and thus permit the setting wheels 20, 22, 24 and 26 to be rotated in discrete angular steps.

Each of the setting wheels 20, 22, 24 and 26 includes a respective pin 68, 70, 72 and 74 slideably disposed in a hole 76 extending through the respective wheels. Each of said pins is spaced an identical radial distance from the center of its respective wheel. As best shown in FIG. 6, each of the pins 68, 70, 72 and 74 is retained on the setting wheels 20, 22, 24 and 26 by a pair of spring clips 78 and 80 which fit within grooves 82 and 84. The grooves 82 and 84 are spaced apart a distance slightly greater than the thickness of the setting wheel 20 so that each pin is free to slide relative to its supporting setting wheel in a direction perpendicular to the face 86 of said setting wheel. The ends 88 and 90 of each of the pins 68, 70, 72 and 74 are rounded to form convex hemispherical portions.

When the combination lock 10 is in the closed position, shown in FIG. 2, the free end 91 of the shackle 12 projects into the case 14 and a slot 92, formed in the shackle 12, engages a hook portion 94 formed on a latch bar 96. The latch bar 96 is mounted on a pivot shaft 98 which is supported on a pivot block 100 mounted on the bottom wall 16 of the case 14. A spring member 102 is also mounted on the pivot block 100 and has an end portion 104 which biases the latch bar 96 inwardly of the case 14, so that the hook portion 94 is normally urged into engagement with the slot 92, thus locking the shackle 12 in closed position.

The shackle 12 has an intermediate annular flange 106 which acts as a stop member to limit the downward travel of the shackle 12 into the case 14 by bearing against the top tall 108 of the case 14. The flange 106 is so located that when it bears against the top wall 108 of the case 14, the slot 92 in the shackle 12 is approximately in line with the hook portion 94 of the latch bar 96, thus facilitating the locking of the combination lock 10. The shackle 12 also includes an end stop 110 which limits the upward travel of the shackle 12 by bearing against the top wall 108, when the combination lock 10 is open.

The lock assembly also includes a plunger bar 112 which is slidably mounted in hole 114 formed in the bottom wall 16 of the case 14 and in a hole 116 formed a plunger support frame 118. The lower portion 120 of the plunger bar 112 extends to the outside of the case 14 and is provided with an actuating button 122. A cam member 124 of frustoconical shape is mounted on an intermediate portion of plunger bar 112, the cam member 124 having an inclined cam surface 126 and a top surface 130. A helical compression spring 128 is positioned between the top surface 130 of the cam member 124 and the bottom surface 132 of the plunger support frame 118. Spring 128 biases the cam member 124 and the plunger bar 112 in a downward direction toward the bottom wall 16 of the case 14. Downward movement of the plunger bar 112 is limited by a stop member 134 disposed on the plunger bar 112 and bearing against the inner surface 136 of the bottom wall 16 of the case 14.

To open the combination lock 10, each of the setting wheels 20, 22, 24 and 26 is rotated manually using the portions 34 of said wheels which project through the slot 18 in the bottom wall 16 of the case 14. Individual rotation of the wheels is continued until a predetermined code of numerals 138, 140, 142 and 144 is centered in the slots 18. The angular relationship between the location of the selected numerals 138, 140, 142 and 144 on each of the cutting wheels 20, 22, 24 and 26 and the sliding pins 68, 70, 72 and 74 on said setting wheels is such that when the selected numerals are centered in the slots 18 all of the sliding pins 68, 70, 72 and 74 form a linear array, as shown in FIG. 3. The user then applies pressure of his finger 146 upon the actuating button 122 and presses plunger bar 112 upwardly. This upward pressure overcomes the force of the helical spring 128 and moves the cam surface against the end 90 of the sliding pin 74. Continued upward pressure causes all of the pins 68, 70, 72 and 74 to slide relative to their respective setting wheels 20, 22, 24 and 26 and to bear against the intermediate portion 148 of the latch bar 96, overcoming the force of the spring member 102 and forcing the hook portion 94 of the latch bar 96 away from the slot 92 in the shackle 12, thus opening the combination lock 10.

The hemispherical ends 88, 90 on each sliding pins 68, 70, 72 and 74 makes it necessary for all of the sliding pins to be in exact alignment in order for the combined length of the pins to be sufficient to operate the latch bar 96. This requirement for exact alignment of the sliding pins adds to the security of the combination lock 10. The spring detent members 58, 60, 62 and 64 cooperating with the notches 44 on the setting wheels 20, 22, 24 and 26 insure that the numerals on the respective wheels are in exact registry with the slots 18 in case 14, and thus insure that the pins 68, 70, 72 and 74 are in precise alignment when the proper combination is set.

The length of the sliding pins 68, 70, 72 and 74 is such that when the combination lock is in the closed position and the setting wheels 20, 22, 24 and 26 are rotated, no friction or noise is produced. There is therefore no way of detecting the position of the sliding pins relative to the various numerals on the peripheral surfaces of the wheels, thus making it impossible for the combination lock 10 to be opened by an unauthorized person skilled in sensing the friction and noise produced by a conventional combination lock.

While a preferred embodiment of the invention has been shown and described herein, it is obvious that numerous additions, changes and omissions may be made in such embodiment without departing from the spirit and scope of the invention.

What is claimed is:

1. A combination lock comprising lock body, a lock-operating member mounted for movement from a normal position toward a second position which it must occupy before the lock can be released, a plurality of individual rotatable members mounted on a common axis in said lock body, a lock-release element carried by each of said rotatable members and positioned thereon to be brought into operative alignment to form a train of said elements when said rotatable members are selectively turned to respective lock-opening positions, each of said lock-release elements being slidably mounted on its respective rotatable member for movement in a direction parallel to the axis of rotation of said rotatable member, and means for engaging one end of the train of aligned lock-release elements and for transmitting a lock-opening force through said train of operatively-aligned lock-release elements to said lock-operating member, in a direction to move the latter to its second position.

2. A combination lock according to claim 1 in which said rotatable members are setting wheels, each having a peripheral surface projecting outwardly of said lock body and exposed at the exterior thereof, and in which each of said lock-release elements comprises a pin slidably mounted on a respective setting wheel and having opposed ends projecting from the opposite faces of said wheel, said pins being brought into axial alignment and forming a linear train when said wheels are turned to said lock-opening positions.

3. A combination lock according to claim 2 in which said force transmitting means comprises cam means movably mounted in said lock body, and plunger means operatively associated with said cam means and having a portion projecting exteriorly of said lock body for manual depression, whereby said plunger means moves said cam means to a lock-release position in which said cam means engages and bears against one end of said linear train of aligned pins to press the other end of said train against said lock-operating member.

4. A combination lock according to claim 2 which also includes a case, a shackle mounted on said case and having a locking portion extending into the interior of said case in the locked condition of said lock, and in which said lock opening member comprises latch means movably mounted within the interior of said case and having a latch portion engageable with the locking portion of said shackle, and biasing means normally urging said latch means to a locked position in which said latch portion is in engagement with said shackle locking portion and said lock is in locked condition.

5. A combination lock according to claim 2 in which said setting wheels each have a peripheral surface divided by a plurality of equally spaced notches.

6. A combination lock according to claim 5 in which said peripheral surfaces, between said notches, are each marked with a numeral.

7. A combination lock according to claim 5 which further includes a spring detent member associated with each of said setting wheels, each spring detent member being biased into engagement with at least one notch of the associated setting wheel, whereby to permit rotation of said setting wheels in discrete steps.

8. A combination lock according to claim 2 in which said sliding pins each have convex rounded ends.

9. A combination lock according to claim 2 in which a pair of limit stops is disposed on each of said sliding pins for limiting the sliding motion of said pin relative to the setting wheel upon which it is mounted.

10. A combination lock according to claim 4 in which said latch means includes a lever pivotally mounted within said case for movement toward and away from said shackle locking portion.

* * * * *